US008789829B2

(12) United States Patent
Kawamata

(10) Patent No.: US 8,789,829 B2
(45) Date of Patent: Jul. 29, 2014

(54) IMAGE RECORDING DEVICE

(71) Applicant: Noriyuki Kawamata, Nagoya (JP)

(72) Inventor: Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/754,182

(22) Filed: Jan. 30, 2013

(65) Prior Publication Data

US 2013/0228966 A1 Sep. 5, 2013

(30) Foreign Application Priority Data

Mar. 1, 2012 (JP) ..... 2012-045131

(51) Int. Cl.
*B41J 29/02* (2006.01)

(52) U.S. Cl.
USPC ..... 271/272; 347/108

(58) Field of Classification Search
USPC ..... 271/272; 310/91; 399/107; 347/108
See application file for complete search history.

(56) References Cited

U.S. PATENT DOCUMENTS 4,335,874 A * 6/1982 Shier et al. ..... 271/95
5,187,497 A * 2/1993 Hirano et al. ..... 347/8
7,317,888 B2 * 1/2008 Obuchi et al. ..... 399/227
8,656,801 B2 * 2/2014 Mizuno ..... 74/421 A
2002/0021343 A1 2/2002 Uchida
2007/0126775 A1 * 6/2007 Silverbrook et al. ..... 347/29
2011/0310206 A1 12/2011 Samoto et al.

FOREIGN PATENT DOCUMENTS

JP H02-266847 A 10/1990
JP H06-115203 A 4/1994
JP 2002-103736 A 4/2002
JP 2003-335021 A 11/2003
JP 2007-090952 A 4/2007

* cited by examiner

*Primary Examiner* — Jeremy R Severson
(74) *Attorney, Agent, or Firm* — Baker Botts L.L.P.

(57) ABSTRACT

A first frame includes a pair of first roller-receiving portions which rotatably supports a convey roller. A second frame is attached to the first frame and includes an extending portion which extends beyond one of the first roller-receiving portions toward one side of the convey roller in its axial direction. A third frame includes a base portion, and a first side wall and a second side wall which are opposite to each other. The first and second side walls are attached to the extending portion so as to he perpendicular to the axial direction of the convey roller. The first side wall is disposed more toward the one side of the convey roller in the axial direction than the second side wall and includes a portion which receives a shaft of a motor for the convey roller, and a second roller-receiving portion which rotatably supports the convey roller.

21 Claims, 6 Drawing Sheets

RIGHT
LEFT
TOP
BOTTOM
FRONT
REAR
D1
D2

IMAGE RECORDING DEVICE

CROSS REFERENCE TO RELATED APPLICATION

This application claims priority from Japanese Patent Application No. 2012-045131, filed on Mar. 1, 2012, the entire disclosure of which is incorporated herein by reference.

BACKGROUND OF THE INVENTION

1. Field of the Invention

The present invention relates to an image recording device configured to record an image on a sheet conveyed by a convey roller.

2. Description of Related Art

A known image recording device is configured to record an image on a sheet conveyed by a convey roller. The convey roller is driven by a motor to convey the sheet, and a recording unit records the image on the sheet conveyed by the convey roller.

In such an image recording device, the motor is usually disposed on one of opposite ends in an axial direction of the convey roller and in proximity to the convey roller. This is because it is necessary to shorten the distance between the axis of the motor shaft and the axis of the convey roller shaft in order to achieve proper transmission of rotation of the motor to the convey roller, improve the sheet feeding accuracy, and ultimately achieve high-quality image recording.

In a known image recording device, a convey roller is supported by opposite ends of a frame, and a convey motor is stored inside of one of the opposite ends of the frame and outside of a sheet conveying area. In this case, a center between the opposite ends that support the convey roller is not aligned with a center of the sheet in an axial direction of the convey roller. The sheet conveying force may be applied unevenly to the sheet in the axial direction. This may reduce the sheet feeding accuracy and cause sheet skew.

In a known image recording device, a convey roller is supported by opposite ends of a main frame, and a convey motor is stored in a sub-frame which is attached to a rear side of the main frame. In this case, although the above-described problem is eliminated, it may be difficult to maintain precisely the distance between the axis of the motor shall and the axis of the convey roller shaft. A slight wobbling of an attaching portion of the sub-frame to the main frame may change the distance between the axes and reduce the sheet feeding accuracy.

SUMMARY OF THE INVENTION

Therefore, a need has arisen for an image recording device that overcomes these and other shortcomings of the related art and is configured to improve the sheet feeding accuracy during image recording.

According to an embodiment of the invention, an image recording device comprises a motor, a convey roller to which a driving force is transmitted from the motor and which is configured to convey a sheet in a conveying direction, a recording unit disposed downstream of the convey roller in the conveying direction and configured to record an image on the sheet, a first frame comprising a pair of first roller-receiving portions which rotatably supports the convey roller, a second frame attached to the first frame and comprising an extending portion which extends beyond one of the pair of the first roller-receiving portions toward one side of the convey roller in an axial direction of the convey roller, and a third frame attached to the extending portion of the second frame. The third frame comprises a base portion, a first side wall continuing from the base portion, and a second side wall continuing from the base portion and opposite to the first side wall. The first side wall and the second side wall are attached to the extending portion of the second frame such that the first side wall and the second side wall are perpendicular to the axial direction of the convey roller. The first side wall is disposed more toward the one side of the convey roller in the axial direction than the second side wall and comprises a motor shaft receiving portion which rotatably supports a rotary shaft of the motor, and a second roller-receiving portion which rotatably supports the convey roller.

According to another embodiment of the invention, an image recording device comprises a motor, a convey roller configured to be driven by the motor, rotate about an axial direction of the convey roller, and convey a sheet in a conveying direction perpendicular to the axial direction, a carriage, a recording head mounted on the carriage and configured to record an image on the sheet conveyed by the convey roller, a base frame comprising a pair of side plates opposite to each other in the axial direction and each comprising a first roller-receiving portion which rotatably supports the convey roller, a carriage frame disposed upstream of the recording head in the conveying direction and supported on the pair of side plates of the base frame, and configured to guide the carriage such that the carriage reciprocates in the axial direction, and a sub-frame attached to the carriage frame. The sub-frame comprises a motor shaft receiving portion which rotatably supports a rotary shaft of the motor, and a second roller-receiving portion which rotatably supports the convey roller. The sub-frame further comprises a first attachment portion and a second attachment portion which are fixed to the carriage frame and are spaced from each other in the axial direction.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

FIG. 4A shows a state in which a belt and a pulley are removed.

FIG. 6A is a left side view of the sub-frame, FIG. 6B is a rear view of the sub-frame, FIG. 6C is a front view of the sub-frame, FIG. 6D is a plan view of the sub-frame, FIG. 6E is a bottom view of the sub-frame, and FIG. 6F is a right side view of the sub-frame.

DETAILED DESCRIPTION OF EMBODIMENTS

Figure 1:
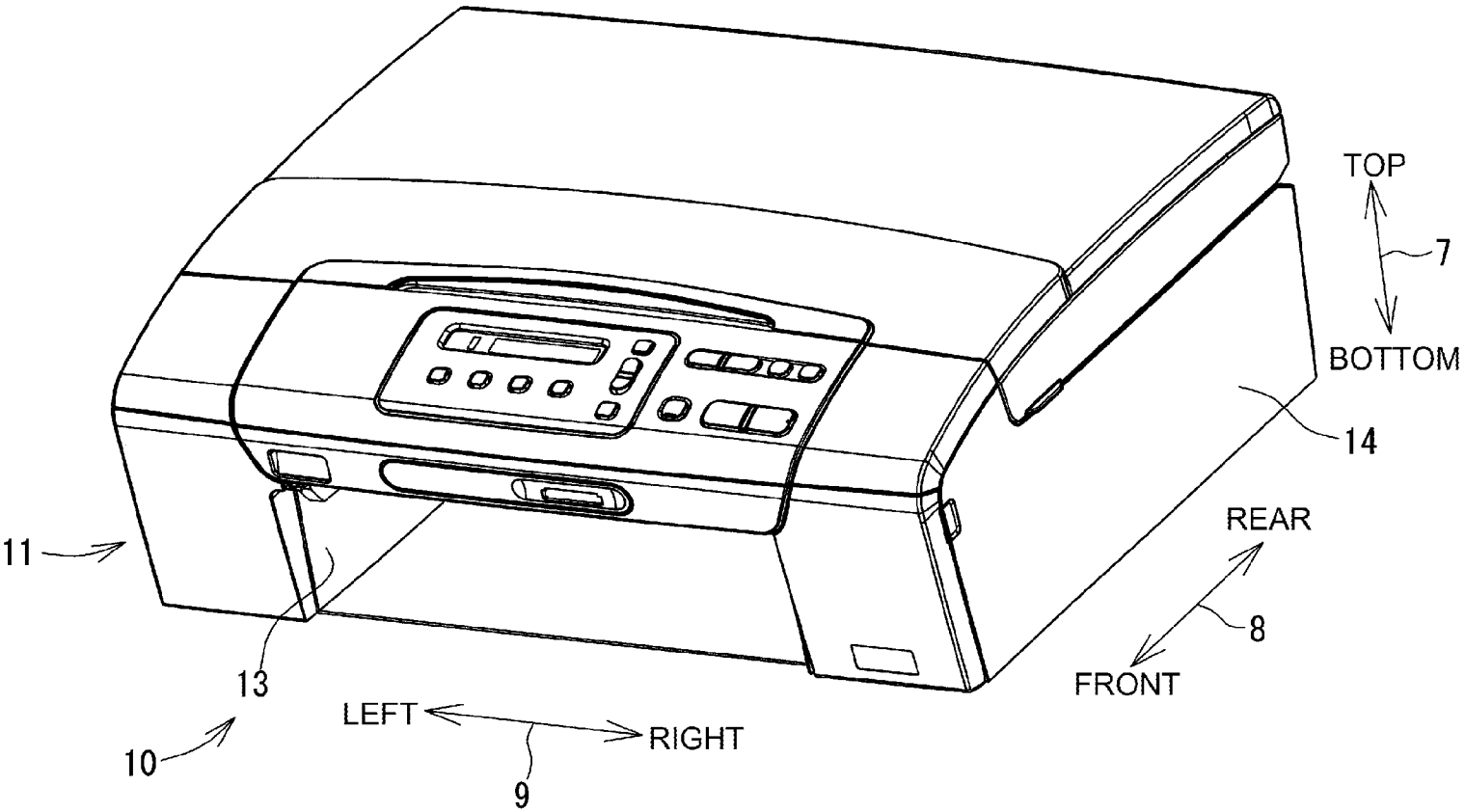
FIG. 1 is a perspective view of a multi-function device, according to an embodiment of the invention.

Embodiments of the invention and their features and technical advantages may be understood by referring to FIGS. 1-6F, like numerals being used for like corresponding parts in the various drawings.

In the following description, a top-bottom direction 7 is defined when a multi-function device 10 is disposed in an orientation (shown in FIG. 1) in which the multi-function device is intended to be used, and a front-rear direction 8 is defined such that a side having an opening 13 is positioned on the front side (at the front), and a right-left direction 9 is defined when the multi-function device 10 is viewed from the front side.

As shown in FIG. 1, the multi-function device 10 (an example of an image recording device) has a generally slim, rectangular parallelepiped shape. An inkjet printer 11 is disposed at a lower portion of the multi-function device 10. The multi-function device 10 has a printing function for recording an image on recording sheets 21 (shown in FIG. 2 as an example of a sheet). The printer 11 comprises a housing 14 having the opening 13 on the front side. A tray 20 configured to hold recording sheets 21 of various sizes is removably inserted from the opening 13 in the front-rear direction 8.

Figure 2:
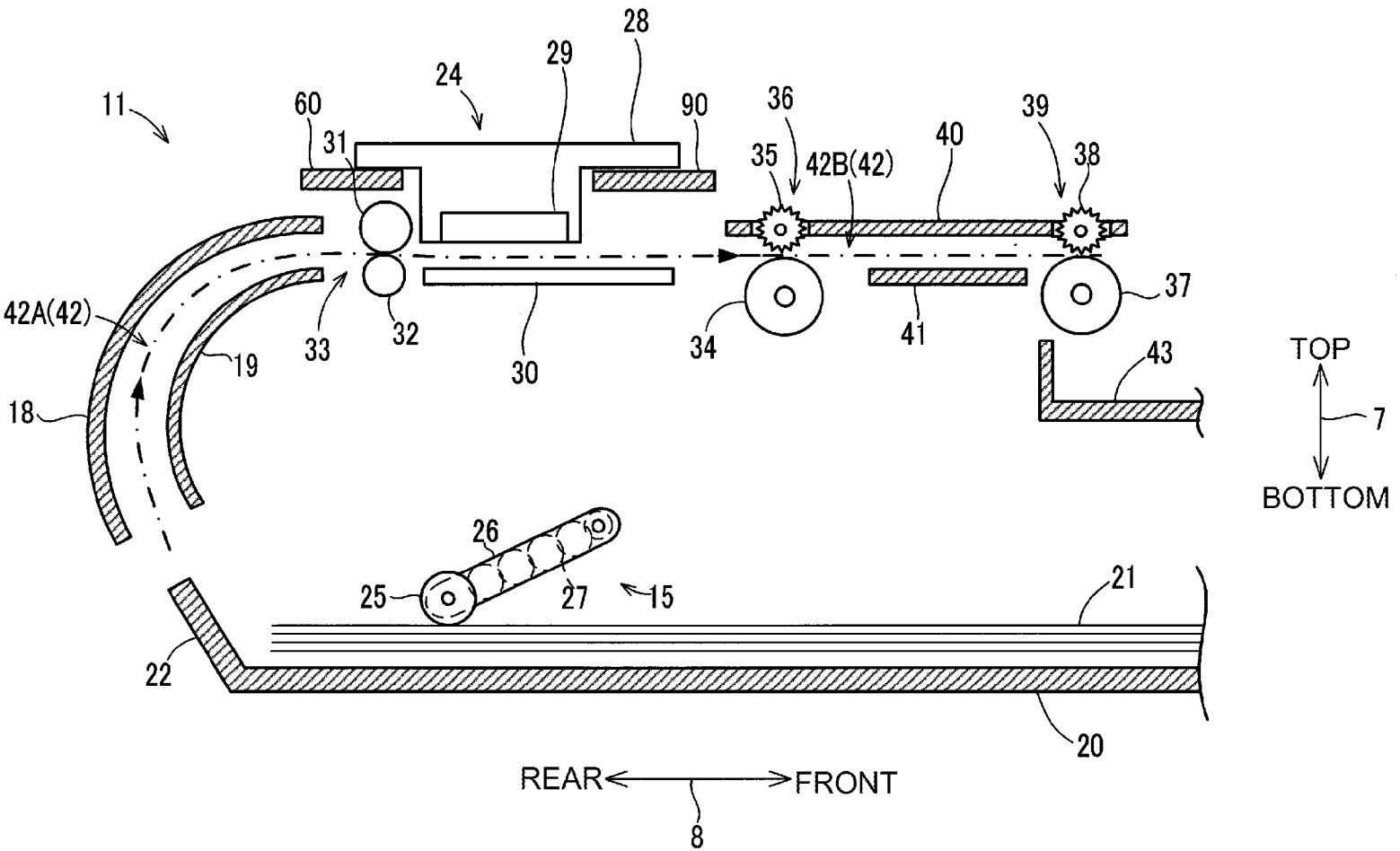
FIG. 2 is a schematic view showing a structure of a printer of the multi-function device.

As shown in FIG. 2, the printer 11 comprises a sheet feeder 15 and a recording unit 24. The sheet feeder 15 is configured to pick up a recording sheet 21 from the tray 20 and feed the recording sheet 21. The recording unit 24 is configured to eject ink onto the recording sheet 21 fed by the sheet feeder 15 and record an image on the recording sheet 21.

As shown in FIG. 2, the sheet feeder 15 comprises a feed roller 25, a feed arm 26, and a drive transmitting mechanism 27. The feed roller 25 is driven to rotate by a feed motor (not shown) via the drive transmitting mechanism 27 which comprises a plurality of gears meshed with one another. The drive transmitting mechanism 27 is disposed in the feed arm 26. The feed roller 25 feeds the recording sheet 21 to an arcuate path 42A, which will be described later.

As shown in FIG. 2, a convey path 42 is formed inside the printer 11 to extend from a rear end of the feed tray 20, via the recording unit 24, to a discharged sheet holder 43. The convey path includes the arcuate path 42A and a discharge path 42B. The arcuate path 42A is defined between the rear end of the feed tray 20 and the recording unit 24. The discharge path 42B is defined between the recording unit 24 and the discharged sheet holder 43.

The arcuate path 42A extends from the proximity of an upper end of an inclined portion 22 of the feed tray 20 to the recording unit 24. The recording sheet 21 is fed from the feed tray 20 in a conveying direction (shown by an arrow in a one-dot-one-dash line in FIG. 2) and is bent along the arcutate path 42A to make a U-turn frontward. The recording sheet 21 is guided to a position right below the recording unit 24. The arcuate path 42A is defined by an outer guide member 18 and an inner guide member 19 which are opposite to each other while leaving a predetermined distance therebetween. The outer guide member 18, the inner guide member 19, and other guide members 40, 41 to be described later extend in the left-right direction 9 (in a direction perpendicular to the drawing sheet plane of FIG. 2).

The discharge path 42B is a straight path extending from a position right below the recording unit 24 to the discharged sheet holder 43. The recording sheet 21 is guided along the discharge path 42B in the conveying direction. The discharge path 42B is defined by the recording unit 24 and a platen 30 which are opposite to each other while leaving a predetermined distance therebetween, and by au upper guide member 40 and a lower guide member 41 which are opposite to each other while leaving a predetermined distance therebetween.

Figure 3:
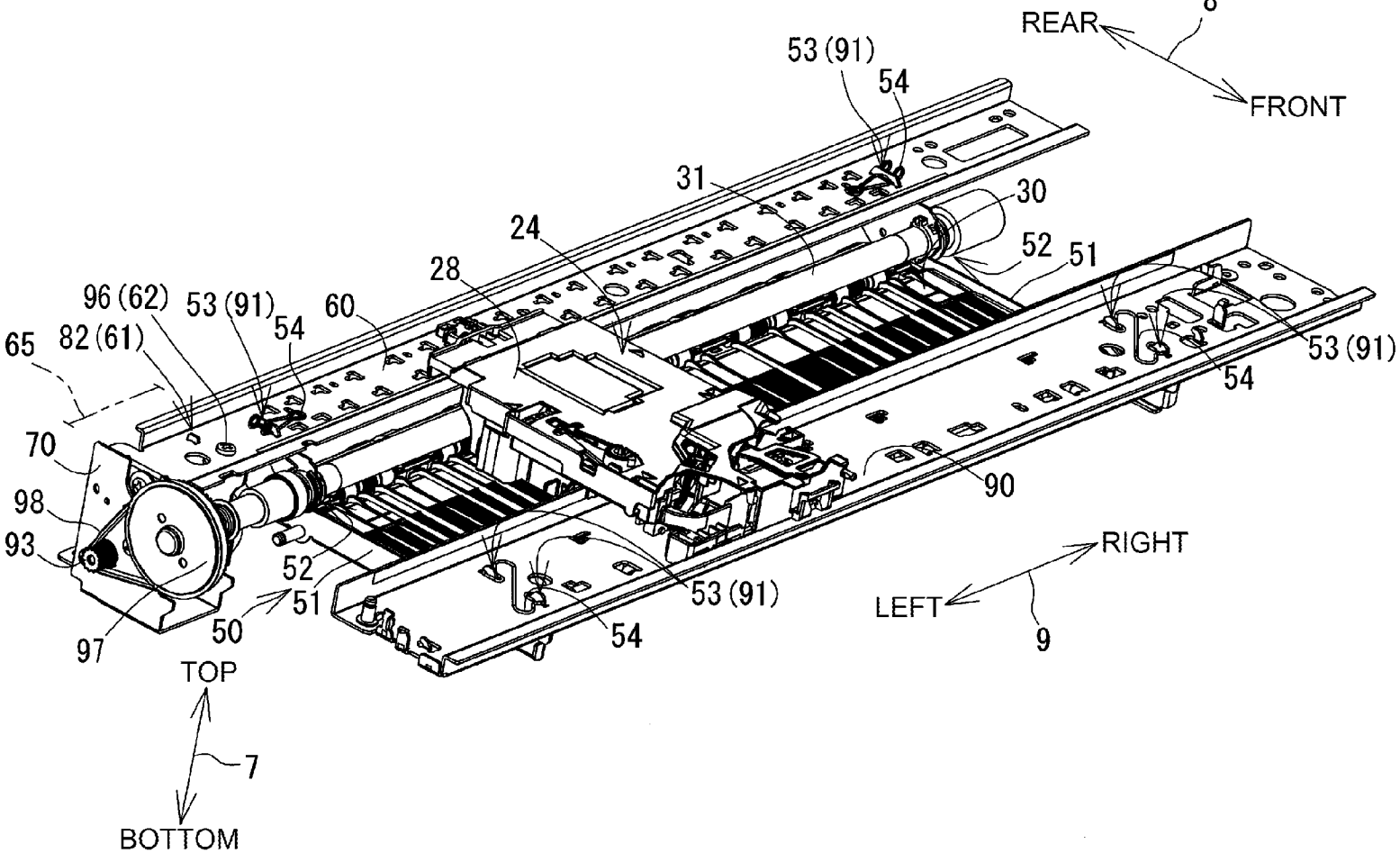
FIG. 3 is a perspective view of the printer and peripheral parts thereof.

As shown in FIG. 2, the recording unit 24 comprises a carriage 28 and a recording head 29 mounted on the carriage 28. As shown in FIG. 3, the carriage 28 is supported by a first carriage frame 60 (an example of a second frame) and a second carriage frame 90. Each of the first carriage frame 60 and the second carriage frame 90 has a substantially flat plate shape and extends lengthwise in a direction parallel to the left-right direction 9. The first carriage frame 60 and the second carriage frame 90 are spaced from each other in the front-rear direction. The carriage 28 is configured to reciprocate, together with the recording head 29, in the left-right direction 9 along the first carriage frame 60 and the second carriage frame 90. The first carriage frame 60 and the second carriage frame 90 function as rails along which the carriage 28 reciprocate.

The platen 30 is disposed at a position below the recording unit 24 so as to oppose the recording unit 24 across the conveying path 42, and is configured to hold the recording sheet 21 horizontally. When the recording head 29 reciprocates in the left-right direction 9, the recording head 40 is configured to eject ink supplied from an ink cartridge (not shown) onto the recording sheet 21 being conveyed on the platen 30. As a result, an image is recorded on the recording sheet 21 conveyed along the conveying path 42.

As shown in FIG. 2, a first roller pair 33 is disposed upstream of the recording unit 24 in the conveying direction and comprises a first convey roller 31 (an example of a convey roller) and a pinch roller 32. The pinch roller 32 is pressed against a roller surface of the first convey roller 31 by an elastic member, e.g., a spring (not shown). The first roller pair 33 is configured to nip the recording sheet 21 fed along the arcuate path 42A and to convey the recording sheet 21 onto the platen 30.

A second roller pair 36 is disposed downstream of the recording unit 24 and comprises a second convey roller 34 and a spur 35. The spur 35 is pressed against a roller surface of the second convey roller 34 by an elastic member, e.g., a spring (not shown). The second roller pair 36 is configured to nip the recording sheet 21 having an image recorded by the recording unit 24 thereon and to convey the recording sheet 21 toward a downstream side in the conveying direction.

A third roller pair 39 is disposed downstream of the second roller pair 36 in the conveying direction and comprises a third convey roller 37 and a spur 38. The spur 38 is pressed against a roller surface of the third convey roller 37 by an elastic member, e.g., a spring (not shown). The third roller pair 39 is configured to nip the recording sheet 21 conveyed by the second roller pair 36 and to convey the recording sheet 21 toward the discharged sheet holder 43.

The first convey roller 31 is driven to rotate by a convey motor 92 (shown in FIGS. 4B and 4C as an example of a motor), via a pinion gear 93, a belt 98, and a pulley 97 (all shown in FIG. 3), as will be described in detail later.

The second convey roller 34 and the third convey roller 37 are driven to rotate by the convey motor 92 or a convey motor (not shown) other than the convey motor 92, via a drive transmitting mechanism (not shown).

As shown in FIG. 3, abuse frame 50 (an example of a first frame) is formed by bending a thin flat metal plate. The base frame 50 comprises side plates 51 formed by bending opposite ends in the left-right direction 9 upward in the top-bottom direction 7. The base frame 50 has a substantially U-shape as viewed in the front-rear direction 8. The platen 30 is disposed inside the side plates 51. The recording sheet 21 is conveyed in an area defined between the side plates 51.

A rear end portion of each of the side plates 51 extends to a higher position in the top-bottom direction 7 than at least a front end portion thereof. A substantially arcuate recess is formed in the rear end portion of each of the side plates 51 to provide a first roller-receiving portion 52. The arcuate recess is open frontward, and an edge portion around the first roller-receiving portion 52 has a claw shape (See FIG. 4C). Each of the first roller-receiving portions 52 is configured to rotatably support the first convey roller 31 via a bearing or the like, such that an axial direction of the first convey roller 31 coincides with the left-right direction 9.

Each of the side plates 51 comprises protrusions 53 protruding upward from opposite ends, in the front-rear direction 8, of the side plate 51. The protrusions 53 of each side plate 51 are used to attach the first carriage frame 60 and the second carriage frame 90 to the base frame 50. The protrusions 53 of the left side plate 51 are opposite to the protrusions 53 of the right side plate 51 respectively in the left-right direction 9. Each of the first carriage frame 60 and the second carriage frame 90 has a plurality of slits 91 into which corresponding protrusions 53 are inserted. Each of the first carriage frame 60 and the second carriage frame 90 is attached to the base frame 50 so as to extend over the side plates 51 in the left-right direction. The first carriage frame 60 is attached to corresponding protrusions 53 on the rear sides of the side plates 51. The second carriage frame 90 is attached to corresponding protrusions 53 on the front sides of the side plates 51. Pins 54 are attached to the protrusions 53 inserted into the slits 91 to prevent the protrusions 53 from being removed from the slits 91.

Each of the first carriage frame 60 and the second carriage frame 90 is formed by bending a thin flat metal plate. The left-right direction 9 and the top-bottom direction 7 of each of the first carriage frame 60 and the second carriage frame 90 are referred to as a lengthwise direction and a thickness direction, respectively. The first carriage frame 60 and the second carriage frame 90 are disposed above the platen 30. Upper and lower surfaces of each of the first carriage frame 60 and the second carriage frame 90 are substantially parallel to a sheet holding surface of the platen 30. The dimension in the left-right direction of each of the first carriage frame 60 and the second carriage frame 90 is longer than that of the base frame 50. Accordingly, opposite ends in the lengthwise direction (left-right direction 9) of each of the first carriage frame 60 and the second carriage frame 90 extend outward beyond the side plates 51 in the left-right direction 9. A portion of the first carriage frame 60 which extends outward beyond the left side plate 51 is referred to as an extending portion 65.

Front and rear ends of each of the first carriage frame 60 and the second carriage frame 90 protrude upward in the top-bottom direction 7. In other words, each of the first carriage frame 60 and the second carriage frame 90 has a substantially U-shape as viewed in the left-right direction 9. The protrusions movably support the carriage 28 in the left-right direction 9.

The first carriage frame 60 is disposed above the first convey roller 31 supported by the first roller-receiving portions 52. The first convey roller 31 is disposed at a front end portion of the first carriage frame 60. The first carriage frame 60 comprises a plate-like standing portion 63 (FIGS. 4A and 4B) which protrudes downward from a left end of the first carriage frame 60 and extends along the top-bottom direction 7 and the front-rear direction 8. The standing portion 63 has a screw hole 62 (FIG. 4B) formed in the center thereof. The extending portion 65 has a slit 61 (an example of a through-hole) formed vertically through the first carriage frame 60, and a screw hole 62. The slit 61 and the screw hole 62 are arranged in the front-rear direction 8, and the screw hole 62 is formed in front of the slit 61. The top-bottom direction 7 in which the standing portion 63 protrudes is an example of a standing direction.

The sub-frame 70 (an example of a third frame) shown in FIGS. 3-6F is formed by bending a thin flat metal plate. The sub-frame 70 comprises a base portion 71, a first side wall 72, and a second side wall 73. The first side wall 72 and the second side wall 73 stand in series from the base portion 71 in the same direction. The first side wall 72 and the second side wall 73 are opposite to each other across the base portion 71. The first side wall 72 and the second side wall 73 are attached to the extending portion 65. In that state (in a state shown in FIGS. 3-4C), a left surface and a right surface of each of the first side wall 72 and the second side wall 73 are perpendicular to the left-right direction 9. Hereinafter, directions and position of various parts are defined in a state in which the sub-frame 70 is attached to the first carriage frame 60.

The base portion 71 is disposed at lower end portions of the first side wall 72 and the second side wall 73. Upper and lower surfaces of the base portion 71 are substantially parallel to upper and lower surfaces of each of the first carriage frame 60 and the second carriage frame 90.

Figure 4A:
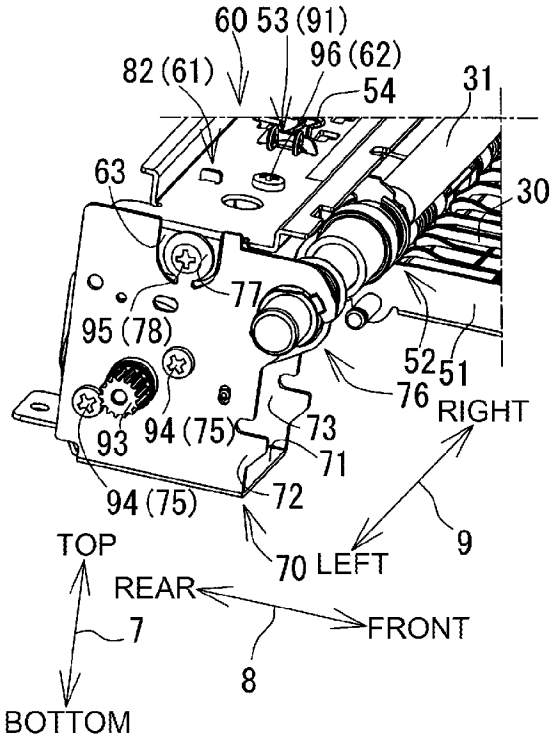
FIGS. 4A-4C are perspective views of a sub-frame and peripheral parts thereof, as viewed from different points of view.

The first side wall 72 is disposed on a left side of the second side wall 73 (on an outer side of the base frame 50 in the left-right direction 9). The first side wall 72 has a first motor hole 74 (FIGS. 5A-6F) at a position behind and below the center thereof. The first motor hole 74 of the sub-frame 70 is used to support the convey motor 92. The convey motor 92 is a rotary motor providing a driving force to the first convey roller 31. The convey motor 92 is supported by the first side wall 72 and the second side wall 73 such that a rotary shaft of the convey motor 92 protrudes leftward through the first motor hole 74. An edge portion (an example of a motor shaft receiving portion) around the first motor hole 74 encloses an end portion of a housing of the convey motor 92 (as shown in FIG. 4A). The rotary shaft of the convey motor 92 is supported by the edge around the first motor hole 74 via the motor housing. A pinion gear 93 (FIG. 4A) is attached to the rotary shaft of the convey motor 92. The first side wall 72 has two screw holes 75 at the periphery of the first motor hole 74. The convey motor 92 is fastened to the first side wall 72 by screws 94 (FIG. 4A) inserted into the screw holes 75. In this way, the convey motor 92 is attached to the sub-frame 70.

An upper portion of the first side wall 72 extends frontward. A substantially arcuate recess is formed in the upper portion to provide a second roller-receiving portion 76. The arcuate recess is open slightly downward such that an edge portion around the second roller-receiving portion 76 has a claw shape. The second roller-receiving portion 76 overlaps the first roller-receiving portions 52 in the left-right direction 9. The second roller-receiving portion 76 is configured to rotatably support the first convey roller 31 via a bearing or the like. The first convey roller 31 is supported, by the first roller-receiving portions 52, at two points along the left-right direction 9 and is supported, by the second roller-receiving portion 76, at a point leftward of the two points (at a point outer than the base frame 50 along the left-right direction 9).

The first convey roller 31 protrudes leftward by 1 cm from the first side wall 72 (as shown in FIG. 4A). The pulley 97 (FIGS. 3 and 4C) is attached to a protruding portion of the first convey roller 31. The pulley 97 is positioned to correspond to the pinion gear 93 in the left-right direction 9. The pulley 97 is positioned in front of and above the pinion gear 93. The belt 98 (FIGS. 3, 4B, and 4C) is wound around the pinion gear 93 and the pulley 97. The circulating direction of the belt 98 is perpendicular to the left-right direction 9. The rotation of the rotary shaft of the convey motor 92 is transmitted to the first convey roller 31 via the pinion gear 93, the belt 98, and the pulley 97.

Figure 4B:
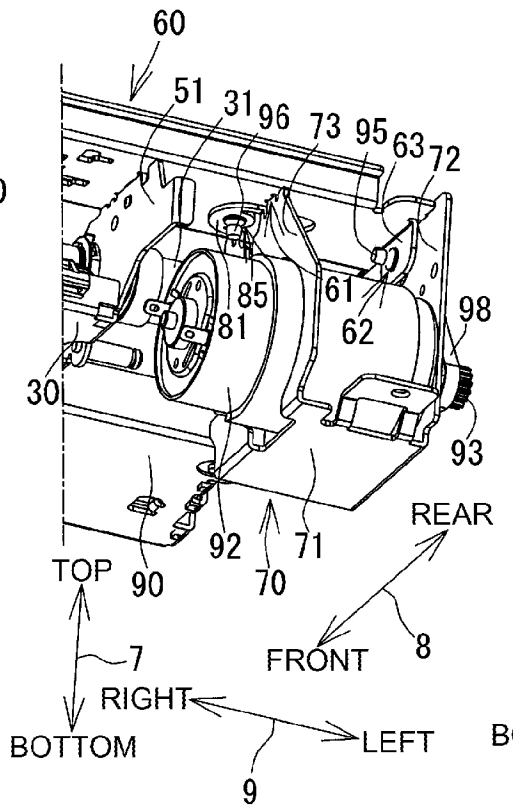

A first attachment portion 77 is formed in the center of an upper end of the first side wall 72. The first side wall 72 has an area E1 (shown in FIG. 5A as an example of a boundary)

formed around the first attachment portion 77 and having a substantially arcuate recess. The first attachment portion 77 has a substantially circular shape and the circumference thereof is disconnected. The first attachment portion 77 is connected only by a first narrower portion 86 (FIG. 5A) to a remaining portion of the first side wall 72 other than the first attachment portion 77. A screw hole 78 is formed in the center of the first attachment portion 77. The first attachment portion 77 is fastened to the standing portion 63 by a screw 95 (an example of a first fixing member) inserted into the screw hole 78 of the first attachment portion 77 and the screw hole 62 of the standing portion 63. In this way, the first attachment portion 77 is fixed to the first carriage frame 60 while a right surface of the first attachment portion 77 is in contact with the standing portion 63 (as shown in FIGS. 4A and 4B). An edge portion around the screw hole 62 of the standing portion 63 is an example of a receiving portion.

Because the recessed area E1 is defined by the narrower portion 86, the first attachment portion 77 is likely to be bent relative to the remaining portion of the first side wall 72 other than the first attachment portion 77. Although not shown in the figures, the first attachment portion 77 is slightly bent such that an upper end thereof is inclined toward the standing portion 63 by a fastening force of the screw 95.

A first contact portion 79 (FIGS. 5B and 5C) is disposed on each of outer sides of the first attachment portion 77 in the front-rear direction 8. The two first contact portions 79 are disposed, along the front-rear direction 8, in the vicinity of an upper end of the right surface of the first side wall 72. The two first contact portions 79 respectively contact two outer points, in the front-rear direction 8, of the standing portion 63 at the left end of the first carriage frame 60. The sub-frame 70 is positioned to the first carriage frame 60 by the first attachment portion 77 and the first contact portions 79.

The second side wall 73 is disposed on the right side of the first side wall 72 (i.e., disposed between the base frame 50 and the first side wall 72 in the left-right direction 9). An upper end of the second side wall 73 is attached to a lower surface of the first carriage frame 60. The second side wall 73 has a second motor hole 80 larger than the first motor hole 74. The center of the second motor hole 80 and the center of the first motor hole 74 are substantially aligned as viewed in the left-right direction 9. A base end of the convey motor 92 (i.e., an opposite end of the convey motor 92 from the end having the protruding rotary shaft) protrudes rightward from the second side wall 73. Approximately one-third of the convey motor 92 on the base end side protrudes through the second motor hole 80 rightward from the second side wall 73.

A part of the upper end of the second side wall 73 is bent rightward along the left-right direction 9 to provide a second attachment portion 81 (FIGS. 48, 5A-5C, and 6A-6F). The second attachment portion 81 is plate-like and has upper and lower surfaces which are substantially parallel to the base portion 71. A distal end (right end) of the second attachment portion 81 has a substantially semicircular shape. At a base end of the second attachment portion 81, an area E2 (shown in FIG. 5A as an example of a boundary) at the boundary between the second attachment portion 81 and a remaining portion of the second side wall 73 is cut out. The area E2 is an opening formed in the second side wall 73. The second attachment portion 81 is connected to the remaining portion of the second side wall 73 by second narrower portions 87 (FIG. 5A) disposed on outer sides of the area E2 in the front-rear direction 8. A screw hole 85 is formed in the center of the second attachment portion 81. The second attachment portion 81 is fastened to the first carriage frame 60 by a screw 96 (an example of a second fixing member) inserted into the screw hole 85 of the second attachment portion 81 and the screw hole 62 of the first carriage frame 60. In this way, an upper surface of the second attachment portion 81 is fixed to a lower surface of the first carriage frame 60 (as shown in FIG. 4B).

Because the area E2 is cut out, the second attachment portion 81 is likely to be bent relative to the remaining portion of the second side wall 73. Although not shown in the figures, a distal end of the second attachment portion 81 is slightly bent upward by a fastening force of the screw 96.

Figure 4C:
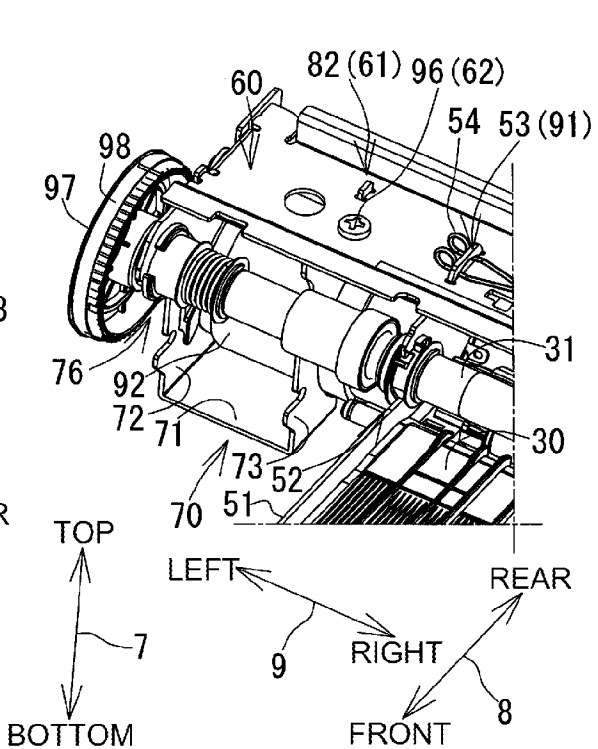
Figure 5A:
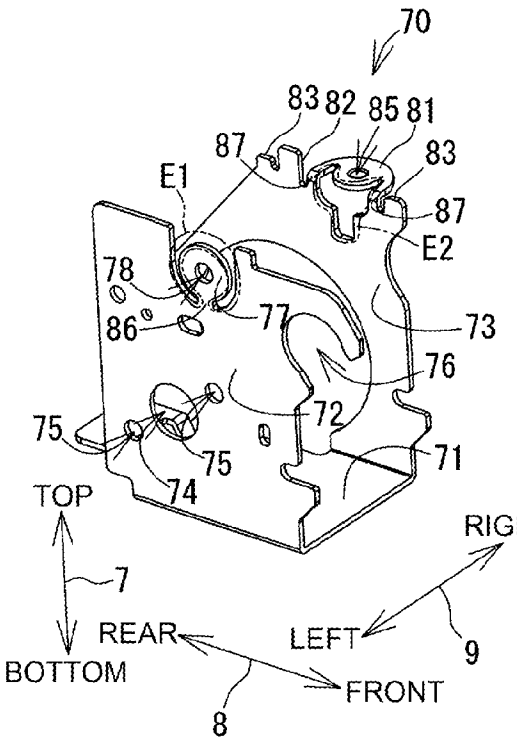
FIGS. 5A-5C are perspective views of the sub-frame as viewed from different points of view.
Figure 5B:
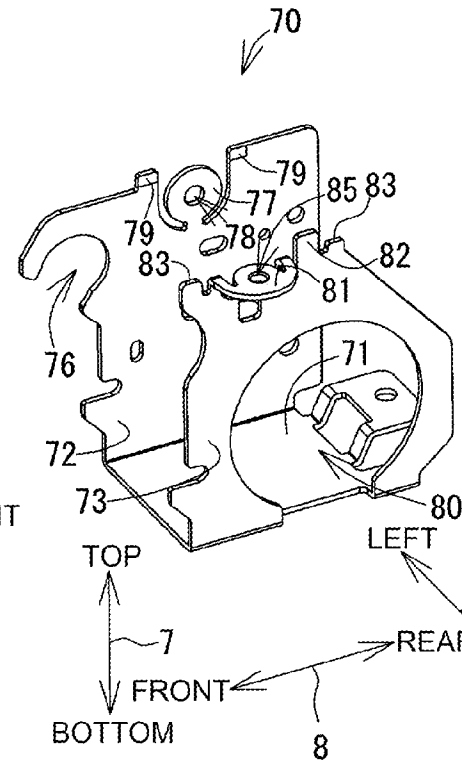
Figure 5C:
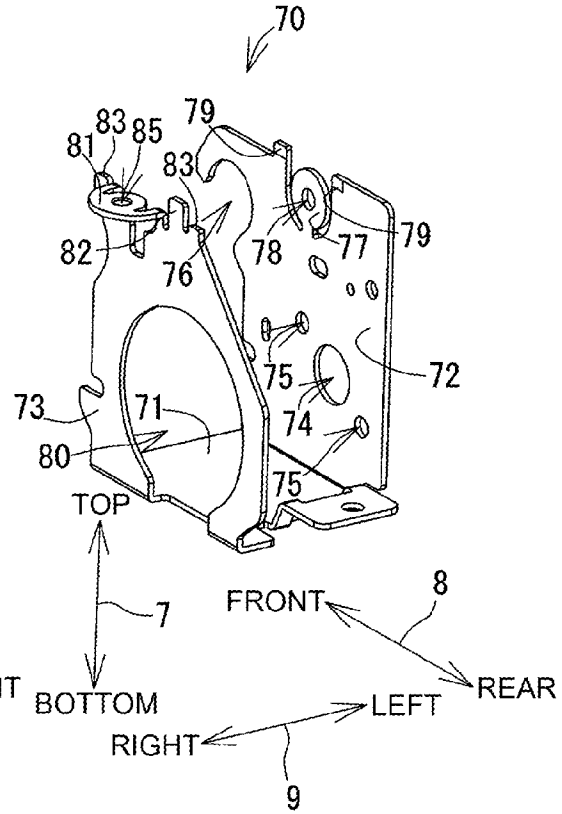
Figures 6A, 6B, 6C, 6D, 6E, 6F:
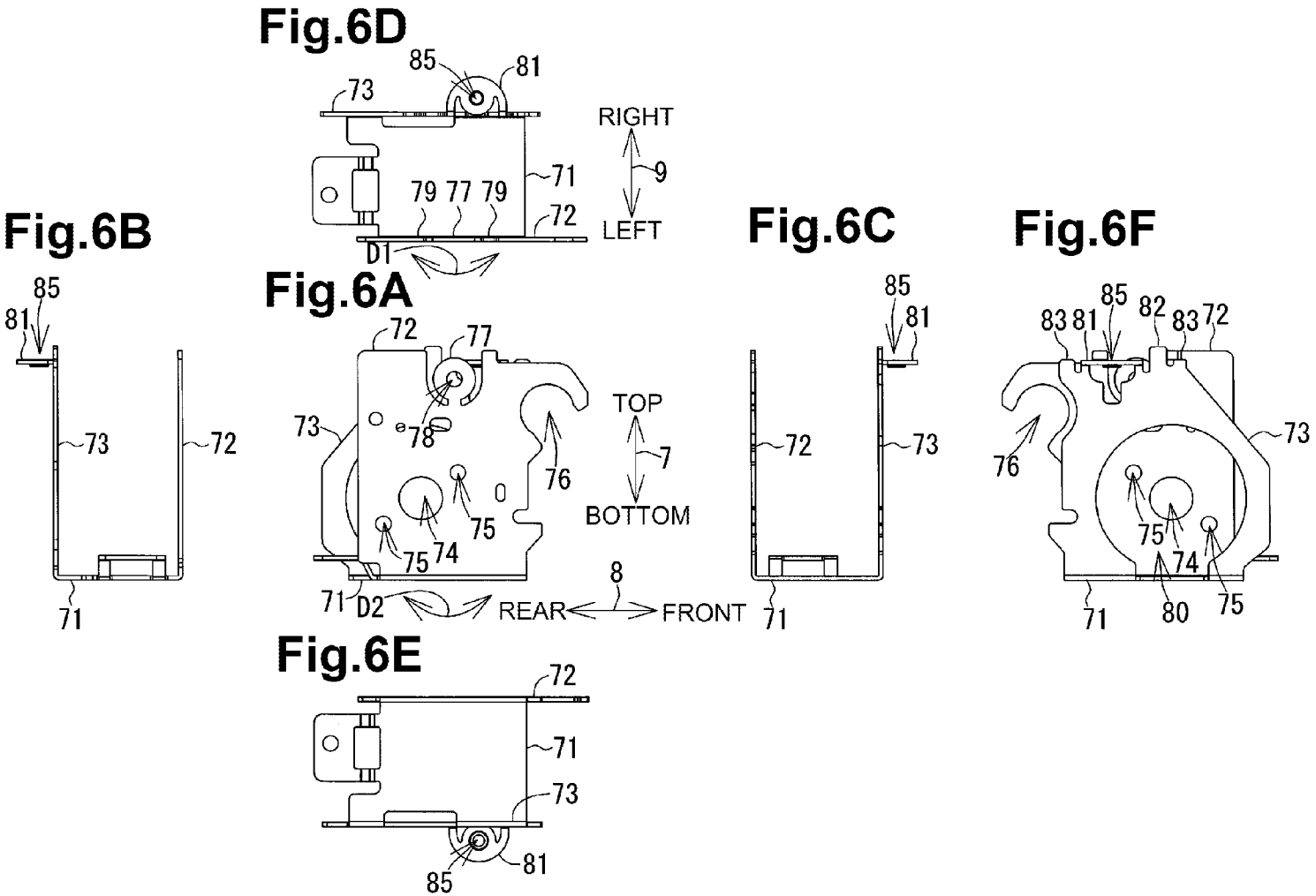
FIGS. 6A-6F are six side views of the sub-frame.

The second side wall 73 comprises a protrusion 82 (an example of a protrusion) which is disposed behind the second attachment portion 81 and protrudes upward by 5 mm from the second attachment portion 81. The protrusion 82 is inserted into a slit 61 of the first carriage frame 60 from below (i.e., from a lower surface of the carriage frame 60). The protrusion 82 inserted into the slit 61 protrudes upward from the upper surface of the first carriage frame 60 (as shown in FIGS. 3, 4A, and 4C). The second side wall 73, when attached, to the first carriage frame 60, is positioned to the first carriage frame 60 in the left-right direction 9 by the slit 61 and the protrusion 82.

A second contact portion 83 (FIGS. 5A-5C and 6A-6F) is disposed on each of outer sides, in the front-rear direction 8, of the second attachment portion 81 and the protrusion 82. The two second contact portions 83 are disposed along the front-rear direction 8. Similar to the protrusion 82, each of the second contact portions 83 is a part of the second side wall 73 protruding upward. An upper end of the second contact portion 83 is slightly above an upper surface of the second attachment portion 81 in the top-bottom direction 7 and is below an upper end of the protrusion 82. When the second attachment portion 81 is fastened to the first carriage frame 60, the upper ends of the second contact portions 83 contact the lower surface of the first carriage frame 60 (as shown in FIG. 4B). The sub-frame 70 is positioned to the first carriage frame 60 by the second attachment portion 81 and the second contact portions 83.

The dimension of the base portion 71 in the left-right direction 9 is slightly longer than the distance between the slit 61 and a left end of the first carriage frame 60. When the sub-frame 70 is attached to the first carriage frame 60, upper end portions of the first side wall 72 and the second side wall 73 are inclined slightly inward. Because the sub-frame 70 is formed by bending a metal plate, an elastic force for returning the sub-frame 70 to its original shape, i.e., an elastic force for moving the first side wall 72 and the second side wall 73 away from each other, is generated. This elastic force maintains the sub-frame 70 in a substantially U-shape as viewed in the front-rear direction 8.

In the above-described embodiment, the two first roller-receiving portions 52 are disposed at positions symmetrical with respect to the center of the platen 30 in the left-right direction 9. A pressing force of a roller surface of the first convey roller 31 to the recording sheet 21 is symmetrical with respect to the center of the platen 30. This may prevent the skew of the recording sheet 21 being conveyed and stabilize feeding of the recording sheet 21.

Because the first side wall 72 supports the rotary shaft of the convey motor 92 and the first convey roller 31, the distance between an axis of the rotary shaft of the convey motor 92 and an axis of the first convey roller 31 may be maintained precisely. The driving force of the convey motor 92 is transmitted to the first convey roller 31, via the pinion gear 93, the belt 98, and the pulley 97. This may reduce an error between the rotation amount of the convey motor 92 and the rotation amount of the first convey roller 31, and improve the feeding accuracy of the recording sheet 21.

The screw 95 for attaching the first side wall 72 to the first carriage frame 60 is inserted, along the left-right direction 9. The screw 96 for attaching the second side wall 73 to the first carriage frame 60 is inserted along the top-bottom direction. The fastening forces of the screws 95, 96 are unlikely to act on the first side wall 72 such that the first side wall 72 shifts or is inclined with respect to the top-bottom direction 7 and the left-right direction 8. Accordingly, the first roller-receiving portions 52 and the second roller-receiving portion 76 are maintained overlapping in the left-right direction 9. This may prevent or reduce a load to be applied to the first convey roller 31. Because the distance between the first motor hole 74 and the first roller-receiving portion 52 remains unchanged, the distance between the axis of the rotary shaft of the convey motor 92 and the axis of the first convey roller 31 may be maintained precisely.

The first attachment portion 77 is likely to be bent relative to the remaining portion of the first side wall 72 other than the first attachment portion 77. This may prevent the entire first side wall 72 from being bent from its intended position by the fastening force of the screw 95. Because the two first contact portions 79 along the front-rear direction 8 are in contact with the left end of the first carriage frame 60, the left and right surfaces of each of the first side wall 72 and the second side wall 73 may be maintained parallel to the front-rear direction 8. Accordingly, the sub-frame 70 may be prevented from wobbling in a direction D1 shown in FIG. 6D.

The second attachment portion 81 is likely to be bent relative to the remaining portion of the second side wall 73 other than the second attachment portion 81. This may prevent the entire second side wall 73 from being bent from its intended position by the fastening force of the screw 96. Because the two second contact portions 83 along the front-rear direction 8 are in contact with the lower surface of the first carriage frame 60, the top and bottom surfaces of the base portion 71 may be maintained parallel to the front-rear direction 8. Accordingly, the sub-frame 70 may be prevented from wobbling in a direction D2 shown in FIG. 6A.

The protrusion 82 inserted into the slit 61 may prevent the upper end of the second side wall 73 from shifting relative to the first carriage frame 60 in the left-right direction 9. The upper end of the second side wall 73 is readily positioned to the first carriage frame 60, and this may facilitate fastening, by the screw 96, the second side wall 73 to the first carriage frame 60 during manufacture of the multi-function device 10.

The dimension of the base portion 71 in the left-right direction 9 is slightly longer than the distance between the slit 61 and the left end of the first carriage frame 60. Accordingly, an elastic force for moving the first side wall 72 and the second side wall 73 away from each other, is generated. This elastic force may maintain the sub-frame 70 in a substantially U-shape as viewed in the front-rear direction 8.

The first carriage frame 60 is attached to the protrusions 53 of the side plates 51 which comprise the first roller-receiving portions 52. Accordingly, the moving direction of the carriage 28 on the first carriage frame 60, which serves as a rail, may correspond with the axial direction of the first convey roller 31 precisely, and high quality image recording may be achieved.

The base frame 50, the first carriage frame 60, and the sub-frame 70 may be readily assembled and manufactured at a relatively low cost.

The first carriage frame 60 may have a different shape from the above-described one as long as the first carriage frame 60 extends beyond the first roller-receiving portions 52. For example, the first carriage frame 60 may not necessarily function as a rail for supporting the carriage 28.

The sub-frame 70 may have surfaces opposite to each other in the front-rear direction 8 and continuing to the first side wall 72 and the second side wall 73, and may have a box shape with the top open. The sub-frame 70 may be attached. to the right side of the first carriage frame 60 instead of the left side thereof. In this case, the first carriage frame 60 and the sub-frame 70 each have a shape of a mirror image that is reversed with respect to the left-right direction 9.

The second roller-receiving portion 73, which is disposed on the front side of the first side wall 72, may be disposed in the middle in the front-rear direction 8 or on the rear side of the first side wall 72. Accordingly, the positions of the first roller-receiving portions 52 may be changed in the front-rear direction 8.

Drive transmission between the rotary shaft of the convey motor 92 and the first convey roller 31 may be performed differently from the above-described embodiment. For example, a plurality of gears, instead of the belt 98, may be rotatably attached to the first side wall 72 or the second side wall 73.

A cylindrical or square shaft which is long in left-right direction 9 may be used instead of the second carriage frame 90 which is formed by bending a thin, flat metal plate.

Each of the frames may not necessarily be made of metal and at least apart of each frame may be made from resin by molding.

The printer 11 may comprise an additional conveying path along which the recording sheet 21 having an image recorded on one side is conveyed back to the recording unit 24 for double-sided recording.

The recording unit 24 may be of the electrophotographic type, instead of the inkjet type.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An image recording device comprising:

a motor;

a convey roller to which a driving force is transmitted from the motor and which is configured to convey a sheet in a conveying direction;

a recording unit disposed downstream of the convey roller in the conveying direction and configured to record an image on the sheet;

a first frame comprising a pair of first roller-receiving portions which rotatably supports the convey roller;

a second frame attached to the first frame and comprising an extending portion which extends beyond one of the pair of the first roller-receiving portions toward one side of the convey roller in an axial direction of the convey roller; and a third frame attached to the extending portion of the second frame and comprising a base portion, a first side wall continuing from the base portion, and a second side wall continuing from the base portion and opposite to the first side wall, wherein the first side wall and the second side wall are attached to the extending portion of the second frame such that the first side wall and the second side wall are perpendicular to the axial direction of the convey roller, and wherein the first side wall is disposed more toward the one side of the convey roller in the axial direction than the second side wall and comprises:

a motor shaft receiving portion which rotatably supports a rotary shaft of the motor for driving the convey roller, and a second roller-receiving portion which rotatably supports the convey roller.

2. The image recording device according to claim 1, wherein the first side wall and the second side wall stand from the base portion in a standing direction which is perpendicular to the conveying direction and the axial direction of the convey roller, wherein the second frame is disposed opposite to a sheet conveying area with the convey roller interposed therebetween and comprises a standing portion which stands in the standing direction, wherein the first side wall comprises a first contact portion which is m contact with the standing portion of the second frame in the axial direction, and wherein the second side wall comprises a second contact portion which is in contact with a surface of the extending portion, the surface of the extending portion being opposite to the convey roller.

3. The image recording device according to claim 2, wherein the standing portion of the second frame comprises a receiving portion, wherein the first side wall comprises a first attachment portion fixed to the receiving portion by a first fixing member which is inserted into the first attachment portion in the axial direction, wherein the second side wall comprises a second attachment portion fixed to the surface of the extending portion by a second fixing member which is inserted into the second attachment portion in the standing direction.

4. The image recording device according to claim 3, wherein the first attachment portion and the second attachment portion are positioned upstream of the second roller-receiving portion in the conveying direction.

5. The image recording device according to claim 3, wherein the second side wall comprises a protrusion protruding beyond the second contact portion in the standing direction, and wherein the extending portion of the second frame has a through-hole into which the protrusion is inserted.

6. The image recording device according to claim 3, wherein the first side wall comprises a first narrower portion at a boundary between the first attachment portion and a first remaining portion other than the first attachment portion, the first narrower portion being narrower than the first attachment portion and the first remaining portion, and wherein the second side wall comprises a second narrower portion at a boundary between the second attachment portion and a second remaining portion other than the second attachment portion, the second narrower portion being narrower than the second attachment portion and the second remaining portion.

7. The image recording device according to claim 3, wherein the third flame comprises a single metal plate which is bent, and wherein a dimension of the base portion in the axial direction is longer than a distance between the first attachment portion and the second attachment portion of the third frame attached to the extending portion of the second frame.

8. The image recording device according to claim 1, wherein the pair of first roller-receiving portions supports the convey roller such that a center, in the axial direction, between the pair of first roller-receiving portions is aligned with a center, in the axial direction, of the sheet conveyed by the convey roller.

9. The image recording device according to claim 1, further comprising:

a pinion gear attached to the rotary shaft of the motor;

a pulley attached to the convey roller at a position more toward the one side of the convey roller in the axial direction than the first side wall; and a belt wound between the pinion gear and the pulley.

10. The image recording device according to claim 1, wherein the recording unit is configured to slide on the second frame, reciprocate along the axial direction, and eject ink droplets onto the conveyed sheet.

11. The image recording device according to claim 1, wherein the second frame is disposed opposite to a sheet conveying area with the convey roller interposed therebetween and comprises a receiving portion disposed at an extending end of the extending portion and standing in a standing direction which is perpendicular to the conveying direction and the axial direction of the convey roller, wherein the first side wall comprises:

two first contact portions spaced in the conveying direction and in contact with the extending end of the extending portion; and a first attachment portion disposed between the two first contact portions and fixed to the receiving portion by a first fixing member which is inserted into the first attachment portion in the axial direction, wherein the second side wall comprises:

two second contact portions spaced in the conveying direction and in contact with a surface of the extending portion, the surface of the extending portion being opposite to the convey roller; and a second attachment portion disposed between the two second contact portions and fixed to the surface of the extending portion by a second fixing member which is inserted into the second attachment portion in the standing direction.

12. The image recording device according to claim 11, wherein the first attachment portion and the second attachment portion are disposed upstream of the second roller-receiving portion in the conveying direction.

13. The image recording device according to claim 1, wherein the third frame comprises a first attachment portion and a second attachment portion, the first attachment portion and the second attachment portion are spaced from each other in the axial direction of the convey roller, the first attachment portion being fixed to the second frame in the axial direction and the second attachment portion being fixed to the second frame in a direction perpendicular to the conveying direction and the axial direction.

14. The image recording device according to claim 1, wherein the motor shaft receiving portion of the first side wall of the third frame supports the rotary shaft of the motor parallel to the axial direction of the convey roller.

15. An image recording device comprising:

a motor;

a convey roller configured to be driven by the motor, rotate about an axial direction of the convey roller, and convey a sheet in a conveying direction perpendicular to the axial direction;

a carriage;

a recording head mounted on the carriage and configured to record an image on the sheet conveyed by the convey roller;

a base frame comprising a pair of side plates opposite to each other in the axial direction and each comprising a first roller-receiving portion which rotatably supports the convey roller;

a carriage frame disposed upstream of the recording head in the conveying direction and supported on the pair of side plates of the base frame, and configured to guide the carriage such that the carriage reciprocates in the axial direction; and a sub-frame attached to the carriage frame and comprising:

a motor shaft receiving portion which rotatably supports a rotary shaft of the motor for driving the convey roller, and a second roller-receiving portion which rotatably supports the convey roller, wherein the sub-frame further comprises a first attachment portion and a second attachment portion which are fixed to the carriage frame and are spaced from each other in the axial direction.

16. The image recording device according to claim 15, wherein the first attachment portion of the sub-frame is fixed to the carriage frame in the axial direction, and the second attachment portion of the sub-frame is fixed to the carriage frame in a perpendicular direction which is perpendicular to the conveying direction and the axial direction.

17. The image recording device according to claim 16, wherein the sub-frame comprises:

a first side wall extending in the perpendicular direction and comprising the first attachment portion, the motor shaft receiving portion, and the second roller-receiving portion;

a second side wall extending in the perpendicular direction and comprising the second attachment portion; and a base portion extending in the axial direction and connecting the first side wall and the second side wall.

18. The image recording device according to claim 17, wherein the first side wall farther comprises a first contact portion in contact with an end surface of the carriage frame, the end surface extending in the perpendicular direction from an end of the carriage frame in the axial-direction, and wherein the second side wall further comprises a second contact portion in contact with an opposite surface of the carriage frame, the opposite surface being opposite to a sheet conveying area in which the sheet is conveyed by the convey roller.

19. The image recording device according to claim 15, wherein the motor is disposed between the sub-frame and one of the pair of side plates of the base frame.

20. The image recording device according to claim 15, further comprising another carriage frame disposed downstream of the recording head in the conveying direction and supported on the pair of side plates of the base frame, and configured to guide the carriage such that the carriage reciprocates in the axial direction, wherein the another carriage frame is separated from the sub-frame.

21. The image recording device according to claim 15, wherein the motor shaft receiving portion of the sub-frame supports the rotary shaft of the motor parallel to the axial direction of the convey roller.

* * * * *